US006197127B1

(12) United States Patent
Okamura et al.

(10) Patent No.: US 6,197,127 B1
(45) Date of Patent: Mar. 6, 2001

(54) CRYOGENIC REFRIGERANT AND REFRIGERATOR USING THE SAME

(75) Inventors: Masami Okamura; Naoyuki Sori, both of Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/125,587

(22) PCT Filed: Feb. 22, 1996

(86) PCT No.: PCT/JP96/00406

§ 371 Date: Aug. 21, 1998

§ 102(e) Date: Aug. 21, 1998

(87) PCT Pub. No.: WO97/31226

PCT Pub. Date: Aug. 28, 1997

(51) Int. Cl.[7] ..... H01F 1/055

(52) U.S. Cl. ..... 148/301; 148/101; 148/303; 62/3.1; 62/6

(58) Field of Search ..... 148/301, 101, 148/303; 420/416; 62/3.1, 6

(56) References Cited

U.S. PATENT DOCUMENTS 5,186,765 2/1993 Arai et al. ..... 148/301
5,333,466 * 8/1994 Harrlington et al. ..... 62/55.5
5,449,416 * 9/1995 Arai et al. ..... 148/301
5,485,730 * 1/1996 Herd ..... 62/51.1
5,593,517 * 1/1997 Saito et al. ..... 148/301

FOREIGN PATENT DOCUMENTS 0 327 293 8/1989 (EP) .
1-310269 12/1989 (JP) .
96/06315 2/1996 (WO) .

* cited by examiner

*Primary Examiner*—John Sheehan
(74) *Attorney, Agent, or Firm*—Foley & Lardner

(57) ABSTRACT

A heat regenerating material for very low temperature use consisting of a magnetic heat regenerating material particle aggregate, wherein, among magnetic heat regenerating material particles constituting the magnetic heat regenerating material particle aggregate, a ratio of the particles being destroyed when a simple harmonic oscillation of the maximum acceleration of 300 m/s$^2$ is added $1\times10^6$ times on the magnetic heat regenerating material particle aggregate is 1% by weight or less. Such a heat regenerating material for very low temperature use has an excellent mechanical characteristics against mechanical vibration and acceleration. A refrigerator comprises a heat regenerator constituted by packing the above described heat regenerating material for very low temperature use into a heat regenerator container. Such a refrigerator can exhibit an excellent refrigeration performance over a long term.

19 Claims, 5 Drawing Sheets

CRYOGENIC REFRIGERANT AND REFRIGERATOR USING THE SAME

TECHNICAL FIELD

The present invention relates to a heat regenerating material which can be used at a very low temperature and for a refrigerator and the like, and a refrigerator using thereof.

BACKGROUND ART

Recent years, progress of the superconductive technology is remarkable, and, as its applicable field is expanded, development of a refrigerator of small size and high performance becomes inevitable issue. For such a refrigerator, light weight/small size and high thermal efficiency are required.

For example, in a superconductive MRI device and a cryopump, a refrigerator operating based on a refrigeration cycle such as a Gifford MacMahon system (GM system) or a Stirling system is used. Further, a high performance refrigerator is indispensable for a magnetic levitation train too, still further, for some single crystal growth devices, a refrigerator of high performance is being used. In such a refrigerator, inside a heat regenerator filled with a heat regenerating material, an operating medium such as a compressed He gas and the like flows in one direction to supply its heat energy to the heat regenerating material, and there expanded operating medium flows in the reverse direction to receive a heat energy from the heat regenerating material. As an recuperating effect becomes good through such a process, the thermal efficiency of the operating medium cycle can be improved, thereby, a further lower temperature can be realized.

As a heat regenerating material to be used for the above described refrigerator, conventionally, there has been mainly used Cu or Pb. However, since these heat regenerating materials become remarkably small in their specific heat at very low temperature of 20 K or less, the above described recuperating effect does not work sufficiently, resulting in difficulty in realization of a very low temperature.

Then, recently, in order to realize a temperature more close to the absolute zero degree, application of magnetic heat regenerating materials such as an Er—Ni based intermetallic compounds such as $Er_3Ni$, ErNi, $ErNi_2$ (ref. Japanese Patent Laid Open No. HEI-1-310269) and RRh based intermetallic compounds (R: Sm, Gd, Tb, Dy, Ho, Er, Tm, Yb) such as ErRh (ref. Japanese Patent Laid Open No. Sho-51-52378), all of which display a large specific heat at very low temperature, are under investigation.

Now, in an operating state of a refrigerator such as described above, an operating medium such as a He gas and the like passes through space between the heat regenerating material filled in the heat regenerator in such a manner that changes frequently its flowing direction under high pressure and with high speed. Therefore, a various kinds of forces including mechanical vibration are added on the heat regenerating material. Further, when a magnetic levitation train or an artificial satellite is equipped with a refrigerator, there operates a large acceleration on the heat regenerating material.

Thus, though various forces act on the heat regenerating material, since the above described magnetic heat regenerating materials consisting of the intermetallic compounds such as $Er_3Ni$ and ErRh are brittle materials in general, due to the cause such as the above described mechanical vibration or acceleration during operation, there was a problem that they were prone to be pulverized. The pulverized fine particles hinder the gas sealing to adversely affect on the performance of the heat regenerator, thus, resulting in deterioration of the capacity of the refrigerator.

An object of the present invention is to provide a heat regenerating material which can be used at a very low temperature and is excellent in their mechanical performance against the mechanical vibration or the acceleration, and a refrigerator which enabled to exhibit an excellent refrigeration performance over a long term by using such a heat regenerating material. Further, the other object is to provide an MRI device, a cryopump, a magnetic levitation train, and a magnetic field application type single crystal growth device all of which are made possible to exhibit excellent performance over a long term by using such a refrigerator.

DISCLOSURE OF INVENTION

A heat regenerating material for very low temperature use of the present invention is a heat regenerating material for very low temperature use comprising a magnetic heat regenerating material particle aggregate, wherein, among the magnetic heat regenerating material particles which constitute the magnetic heat regenerating material particle aggregate, the ratio of the magnetic heat regenerating material particles which are destroyed when a simple harmonic oscillation of the maximum acceleration of 300 $m/s^2$ is added on the magnetic heat regenerating material particle aggregate $1\times10^6$ times is 1% by weight or less.

A refrigerator of the present invention comprises a heat regenerator container and a heat regenerator having the above described heat regenerating material for very low temperature use of the present invention which is filled in the heat regenerator container.

Further, all of an MRI (magnetic Resonance Imaging) device, a cryopump, a magnetic levitation train, and a magnetic field application type single crystal growth device of the present invention comprises the above described refrigerator of the present invention.

The heat regenerating material for very low temperature use of the present invention is consisting of a magnetic heat regenerating material particle aggregate, that is, an aggregate (group) of the magnetic heat regenerating material particles. As a heat regenerating material to be used in the present invention, for instance, an intermetallic compound including a rare earth element and expressed by the following general formula, $$\text{General formula: } RM_z \quad (1)$$

(in the formula, R denotes at least one kind of rare earth element selected from Y, La, Ce, Pr, Nd, Pm, Sm, Eu, Gd, Tb, Dy, Ho, Er, Tm and Yb, M denotes at least one kind of metallic element selected form Ni, Co, Cu, Ag, Al and Ru, z denotes a number of in the range of 0.001 to 9.0. Same in the following) or an intermetallic compound including a rare earth element and expressed by the following general formula $$\text{general formula: } RRh \quad (2)$$

can be cited.

The above described heat regenerating material particles make more smooth the gas flow when their particle diameters are more uniform and their shape are more spheroidal. Thus, 70% by weight or more of the magnetic heat regenerating material particle aggregate (total particles) is preferable to be constituted of the magnetic heat regenerating material particles of particle diameter in the range of 0.01 to 3.0 mm. When the particle diameter of the magnetic heat regenerating material particles is less than 0.01 mm, their packing density becomes too high, thus the pressure loss of the operating medium such as He is likely to be increased. On the contrary, the particle diameter exceeds 3.0 mm, heat transmitting surface area between the magnetic heat regenerating material particles and the operating medium becomes small, resulting in degradation of heat transmission efficiency. Therefore, when such particles occupy more than 30% by weight of the magnetic heat regenerating material particle aggregate, deterioration of heat regenerating performance or the like is likely to be invited. The more preferable particle diameter is in the range of 0.05 to 2.0 mm, still more preferable to be in the range of 0.1 to 0.5 mm. The ratio of the particles of which particle diameter are in the range of 0.01 to 3.0 mm in the magnetic heat regenerating particle aggregate is more preferable to be 80% by weight or more, still more preferable to be 90% by weight or more.

The heat regenerating material for very low temperature use of the present invention is composed of a magnetic heat regenerating material particle aggregate in which the ratio of the magnetic heat regenerating material particles destroyed when a simple harmonic oscillation of the maximum acceleration of 300 $m/s^2$ is added $1\times10^6$ times on the above described group of the magnetic heat regenerating material particles is 1% by weight or less.

The present invention takes notice of the mechanical strength as a group of magnetic heat regenerating material particles in which the mechanical strength of individual magnetic regenerating material particle is related in a complicated manner with contents of nitrogen and carbon as impurity, cooling speed and metallographic texture during solidifying process, shape and the like, and, when formed a group, complex stress concentration is generated. By measuring the ratio of particles which are destroyed when a simple harmonic oscillation of the maximum acceleration of 300 $m/s^2$ is added $1\times10^6$ times on such a group of magnetic heat regenerating material particles, that is, the magnetic heat regenerating particle aggregate, reliability of the mechanical strength of the magnetic heat regenerating material particle aggregate can be evaluated.

That is, when the ratio of the particles destroyed when a simple harmonic oscillation of the maximum acceleration of 300 $m/s^2$ is added $1\times10^6$ times on a magnetic heat regenerating material particle aggregate is 1% by weight or less, irrespective of difference between manufacturing lots of the magnetic heat regenerating material particle aggregate, further between manufacturing conditions, the magnetic heat regenerating material particles hardly undergo pulverization due to mechanical vibration during operation of the refrigerator or due to the acceleration induced by the movement of the system on which the refrigerator is mounted. Therefore, by employing the magnetic heat regenerating material particle aggregate of such the mechanical property, hindrance of gas seal in a refrigerator can be prevented from occurring. The ratio of the magnetic heat regenerating material particles destroyed when a simple harmonic oscillation of the maximum acceleration of 300 $m/s^2$ is added $1\times10^6$ times on a magnetic heat regenerating material particle aggregate is more preferable to be 0.5% by weight or less, still more preferable being 0.1% by weight or less.

Now, when the maximum acceleration in the vibration test (acceleration test) is below 300 $m/s^2$, the magnetic heat regenerating material particles are hardly destroyed, thus, reliability can not be evaluated. In addition, when the repeating times of the simple harmonic oscillation of the maximum acceleration of 300 $m/s^2$ added on the magnetic heat. regenerating material particle aggregate is below $1\times10^6$ times, to the acceleration and the like acting on the magnetic heat regenerating material particle aggregate due to the movement of the system on which the refrigerator is mounted, sufficiently practical evaluation of reliability can not be carried out. In the present invention, the condition of the above described vibration test is important, by specifying the maximum acceleration and the vibration times of the simple harmonic oscillation to the above described values, for the first time, reliability of the magnetic heat regenerating material particle aggregate under practical employing condition is made possible to be evaluated. According to the reliability evaluation of a magnetic heat regenerating material particle aggregate, when a simple harmonic oscillation of the maximum acceleration of 400 $m/s^2$ is added $1\times10^6$ times, or a simple harmonic oscillation of the maximum acceleration of 300 $m/s^2$ is added $1\times10^7$ times, the ratio of the destroyed magnetic heat regenerating material particles is more preferable to be 1% by weight or less.

The above mentioned reliability evaluation test (vibration test) of the magnetic heat regenerating material particle aggregate is carried out in the following manner. First, a definite quantity of magnetic heat regenerating material particles are extracted at random for each manufacturing lot from the magnetic heat regenerating material particle aggregate of which particle diameter and the like are in the range of provision. Then, the extracted magnetic heat regenerating material particle aggregate is filled in a cylindrical vessel 1 for vibration test use as illustrated in FIG. 1 and a simple harmonic oscillation of the maximum acceleration of 300 $m/s^2$ is added $1\times10^6$ times. For material of the cylindrical vessel 1 for vibration test use, alumilite and the like can be employed. After the vibration test, the destroyed magnetic heat regenerating material particles are selected due to sieving or shape classification, by measuring its weight, reliability as a group of the magnetic heat regenerating material particles can be evaluated.

Now, the density (packing ratio) packing the magnetic heat regenerating material particle aggregate in the vessel for vibration test use depends in a complicated manner on the shape and the particle diameter distribution of the magnetic heat regenerating material particles, however, if the packing ratio is too low, due to existence of free space in which the magnetic heat regenerating material particles can move around in the test vessel, vibration resistance performance of the magnetic heat regenerating material particle aggregate can not be evaluated accurately. On the contrary, if the packing ratio is set at too high, due to requirement of the compression during charging of the magnetic heat regenerating material particles into the test vessel, the compression power at that time is likely to induce destruction. Therefore, it is required to test varying the packing ratio in the wide range. That is, in the present invention, the ratio of the magnetic heat regenerating material particles destroyed due to the vibration test is evaluated by varying the packing ratio variously for one lot, among them, the minimum value of the ratio of the destroyed magnetic heat regenerating material particles is adopted as a measured value.

The heat regenerating material for very low temperature use of the present invention, if it satisfied the above described reliability evaluation test (vibration test), is not restricted in its composition and the shape, but, concerning impurity concentration in the particle and shape which may be one cause of the particle destruction due to the mechanical vibration and the acceleration, the following conditions are desired to be satisfied.

(a) In a state processed to particle shape, nitrogen content as impurity in magnetic heat regenerating material particles should be 0.3% by weight or less.

(b) In a state processed to the particle shape, carbon content as impurity in a magnetic heat regenerating material particles should be 0.1% by weight or less.

(c) When a circumferential length of a projection image of each particle constituting the magnetic heat regenerating material particle aggregate is L, a true area of the projection image is A, existence ratio of the particles of which shape factor R expressed by $L^2/4\ \pi A$ exceeds 1.5 is 5% or less.

That is, nitrogen and carbon as impurity in the magnetic heat regenerating material particles cause deterioration of the mechanical strength of the magnetic heat regenerating material particles by precipitating rare earth nitride or rare earth carbide at grain boundary of the magnetic heat regenerating material expressed by the above described equation (1) and equation (2). In other words, reduction of these nitrogen and carbon content can bring about an excellent mechanical strength with stability, can satisfy the reliability evaluation test (vibration test) with reproducibility. From these reasons, the nitrogen content as an impurity in the magnetic heat regenerating material particles is preferable to be 0.3% by weight or less, and the carbon content is preferable to be 0.1% by weight or less. The nitrogen content as an impurity is more preferable to be 0.1% by weight or less, still more preferable to be 0.05% by weight or less. In addition, the carbon content as an impurity is more preferable to be 0.05% by weight or less, still more preferable to be 0.02% by weight or less.

Further, the shape of the magnetic heat regenerating material particles is preferable to be spheroidal as described above, as the degree of sphericity becomes higher and the surface becomes more smooth, in addition to the smooth gas flow, an extreme stress concentration can be suppressed when the mechanical vibration or the like is added on the magnetic heat regenerating material particle aggregate. Thereby, the mechanical strength as a group of the magnetic heat regenerating material particles can be heightened. That is, the more complicated the surface shape becomes such as projection being existing on the particle surface, the stress concentration is likely to be generated when the magnetic heat regenerating material particles are subjected to force, thereby adversely affects on the mechanical strength of the magnetic heat regenerating material particle aggregate.

Now, when the circumferential length of the projection image of each particle constituting the magnetic heat regenerating material particle aggregate is L, the true area of the projection image is A, it is preferable that the existence ratio of the particles of which shape factor R expressed by $L^2/4\ \pi A$ exceeds 1.5 is 5% by weight or less. Incidentally, the shape factor R is preferable to be evaluated through image processing of these after, for instance, extraction of 100 pieces or more of particles at random for each manufacturing lot of the magnetic heat regenerating material particle aggregate. If the extracted number of the particles is too small, an accurate evaluation of the shape factor R of the magnetic heat regenerating material particle aggregate as a whole is likely to be threatened.

The above described shape factor R, even when it is high in its degree of sphericity as a whole shape, becomes a large value (large partial shape irregulality) if there are projections and the like on the surface. On the contrary, when the surface is relatively smooth, even if the degree of sphericity is a little low, the value of the shape factor R becomes low. Thus, the shape factor R tends to be a large value as the more projections or the like exist on the surface of the particle. That is, the shape factor R being small means the surface of the particle being relatively smooth (small partial shape irregulality), it is a parameter effective for evaluation of the local shape of the particle. Therefore, by rendering the existence ratio of the particles, of which the shape factor R exceeds 1.5, 5% or less, the mechanical strength of the magnetic heat regenerating material particle aggregate can be improved.

The existence ratio of the particles of which shape factor R exceeds 1.5 is more preferable to be 2% or less, still more preferable to be 1% or less. Further, the existence ratio of the particles of which shape factor R exceeds 1.3 is preferable to be 15% or less. The existence ratio of the particles of which shape factor R exceeds 1.3 is more preferable to be 10% or less, still more preferable to be 5% or less.

The manufacturing method of the above described magnetic heat regenerating material particle aggregate is not particularly restricted, but various kinds of manufacturing methods can be employed. For instance, such method can be employed that a molten metal of a predetermined composition is solidified by quenching with centrifugal atomization, gas atomization, rotating electrode method and the like to make particulate. In this case, through use of high purity raw material, or through reduction of impurity gas content in the atmosphere during quenching/solidification, the nitrogen content and the carbon content in the magnetic heat regenerating material particles can be decreased. Further, for instance, through optimization of the manufacturing condition or through shape classification due to inclined vibration, the magnetic heat regenerating material particle aggregate in which the existence ratio of the particles exceeding 1.5 in its shape factor R is 5% or less can be obtained.

The refrigerator of the present invention comprises a heat regenerator which uses, as a heat regenerating material for very low temperature use to be filled in a heat regenerator, a magnetic heat regenerating material particle aggregate having the above described mechanical property, that is, the magnetic heat regenerating material particle aggregate in which the ratio of the particles destroyed when a simple harmonic oscillation of the maximum acceleration of 300 $m/s^2$ is added $1\times10^6$ times is 1% by weight or less.

The heat regenerating material to be used in a refrigerator of the present invention, since there are hardly any magnetic heat regenerating material particles that can be caused to be pulverized due to the above described mechanical vibration during operation of the refrigerator and due to acceleration due to movement of the system on which the refrigerator is mounted, the refrigerator is not hindered from gas seal. Therefore, refrigerating performance can be maintained over a long term with stability.

And, in an MRI device, a cryopump, a magnetic levitation train, and a magnetic field application type single crystal growth device, since, in all of them, performance of the refrigerator dominates performance of each device, an MRI device, a cryopump, a magnetic levitation train, and a magnetic field application type single crystal growth device in which the above described refrigerators are used can exhibit excellent performance over a long term.

MODE FOR CARRYING OUT THE INVENTION

In the following, the present invention will be described with embodiments.

Embodiment 1

COMPARATIVE EXAMPLE 1

First, an $Er_3Ni$ mother alloy is produced with high frequency melting. This $Er_3Ni$ mother alloy is melted at about 1263 K, the molten metal is dropped on a rotating disc in an Ar atmosphere (pressure=about 80 kPa) to rapidly cool and solidify. The obtained particle aggregate is classified according to shape classification and sieved to select 1 Kg of spheroidal particles of particle diameter of 180 to 250 $\mu$m. By repeating this process, 10 lots of spheroidal $Er_3Ni$ particle aggregate are obtained.

Figure 1:
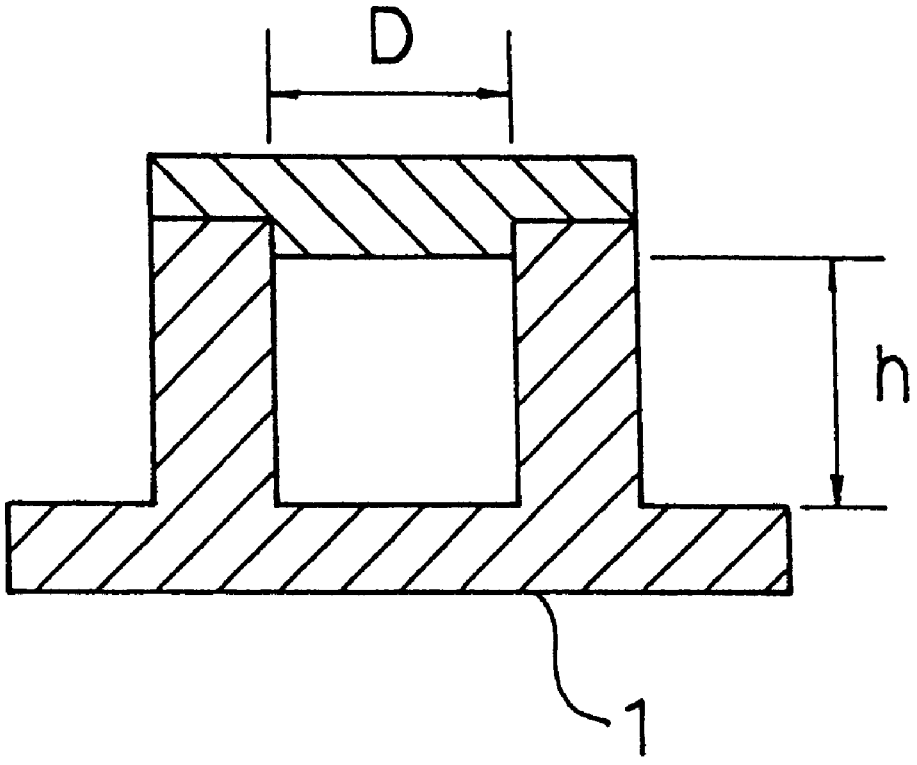
FIG. 1 is a cross-sectional view showing one example of a vessel for vibration test use to be used for reliability evaluation test of a magnetic heat regenerating material particle aggregate of the present invention.

Then, $Er_3Ni$ particles extracted at random from the above mentioned 10 lots of each spheroidal $Er_3Ni$ particle aggregate are packed in a vessel for vibration test use 1 (D=15 mm, h=14 mm) shown in FIG. 1, respectively, and a simple harmonic oscillation of the maximum acceleration of 300 $m/s^2$ is added $1\times10^6$ times on them with a vibration test machine. Each particle aggregate undergone the test is adequately classified due to shape classification and sieved, the ratio of the destroyed spheroidal $Er_3Ni$ particles was obtained. The ratios (destruction rate) of the destroyed particles for each lot are shown in Table 1. As evident from Table 1, each spheroidal $Er_3Ni$ particle aggregate of sample No. 1 to sample No.8 corresponds to embodiment 1, each spheroidal $Er_3Ni$ particle aggregate of sample No.9 to sample No.10 corresponds to comparative example 1.

Figure 2:
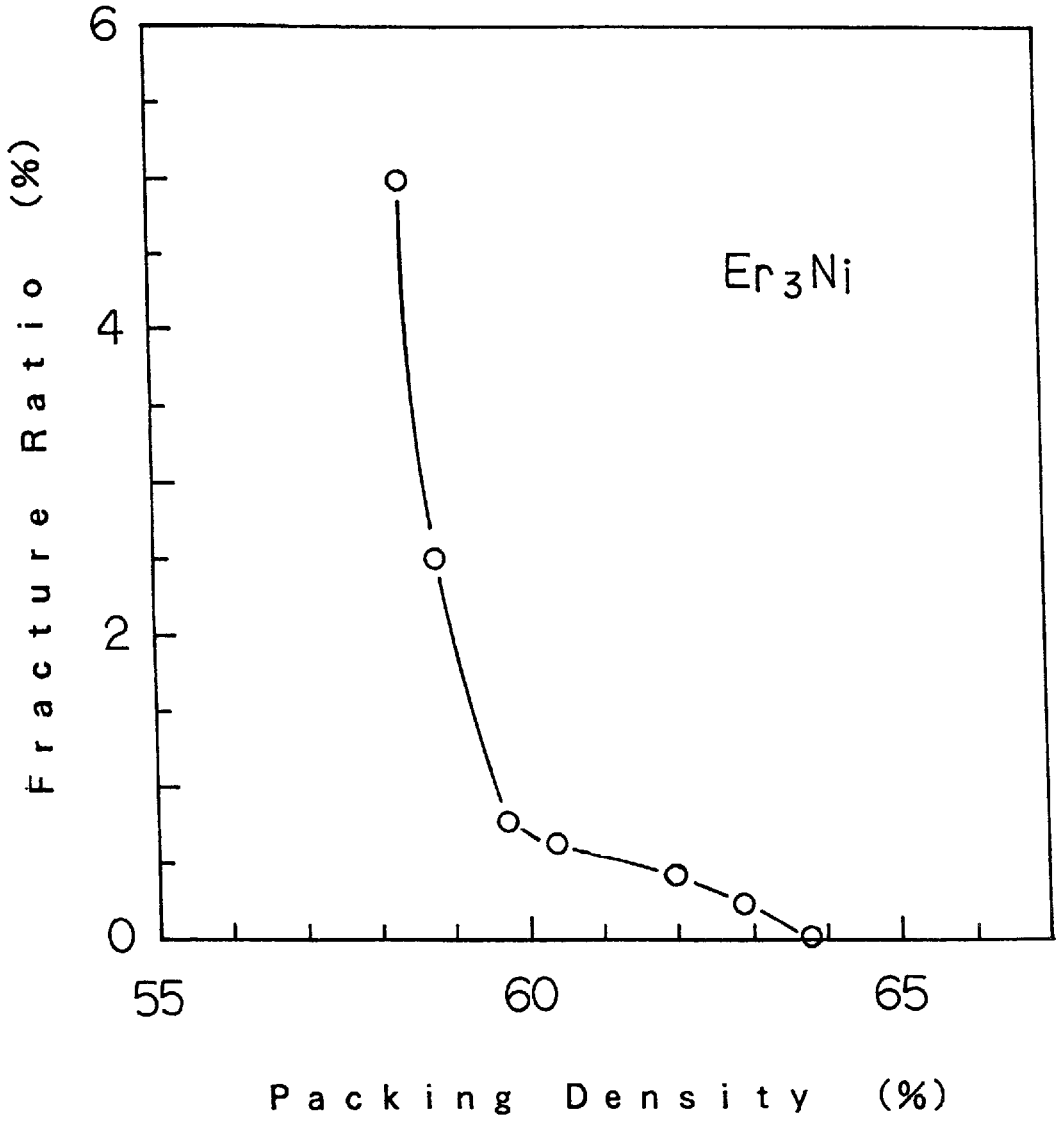
FIG. 2 is a diagram showing relationship between packing ratio of the magnetic heat regenerating material particle aggregate according to one example of the present invention into a vessel for vibration test use and the ratio of particles destroyed by vibration test.

Here, the packing ratios of $Er_3Ni$ particles into the vessel for vibration test use 1 are varied in the range of 55 to 66%, the minimum destruction rate is adopted as the destruction rate of the lot. FIG. 2 shows a relation between the packing ratio of spheroidal $Er_3Ni$ particle aggregate of sample No.1 into a vessel for vibration test use and the destruction rate due to the vibration test. In FIG. 2, since the destruction rate became 0 (below the detection limit) at the packing ratio of 63.7%, this value is the destruction rate of this lot. Incidentally, above that packing ratio, the test was not carried out.

Figure 3:
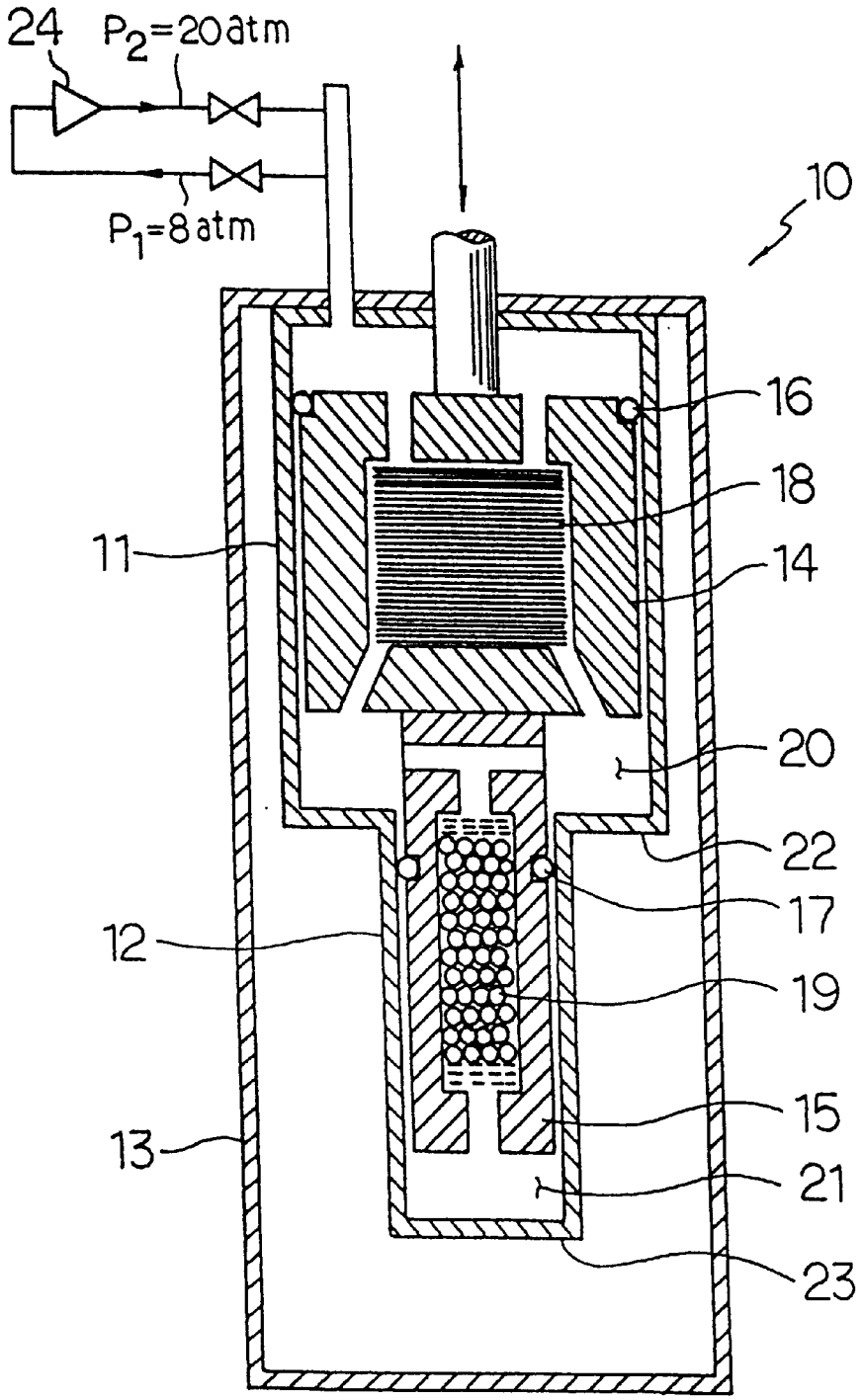
FIG. 3 is a diagram showing a structure of anessential portion of a GM refrigerator manufactured according to one embodiment of the present invention.

The magnetic heat regenerating material spheroidal particle aggregate of each lot consisting of the above described $Er_3Ni$ is packed into a heat regenerator container with the packing ratio of 63.5 to 63.8% to manufacture a heat regenerator, each heat regenerator is assembled in 2 stage GM refrigerator shown in FIG. 3 as a second stage heat regenerator (the second heat regenerator 15), and refrigeration test was carried out. The result are also. shown in Table 1.

TABLE 1

| | Sample No. | Destruction rate of particle due to vibration test (wt %) | Refrigeration capacity (W) Initial value | Refrigeration capacity (W) After 7000 hours |
|---|---|---|---|---|
| Embodiment 1 | 1 | 0* | 0.34 | 0.33 |
| | 2 | 0.41 | 0.35 | 0.28 |
| | 3 | 0.02 | 0.35 | 0.32 |
| | 4 | 0* | 0.34 | 0.34 |
| | 5 | 0.76 | 0.36 | 0.26 |
| | 6 | 0.55 | 0.35 | 0.25 |
| | 7 | 0.03 | 0.35 | 0.33 |
| | 8 | 0.25 | 0.36 | 0.29 |
| Comparative example 1 | 9 | 1.59 | 0.34 | 0.07 |
| | 10 | 2.17 | 0.36 | 0.04 |

*: The value below the detection limit of 0.001% by weight is denoted as 0.

As obvious from Table 1, all of the refrigerators employing magnetic heat regenerating particle aggregate, in which the ratio of the particles destroyed when a simple harmonic oscillation of the maximum acceleration of 300 $m/s^2$ is added $1\times10^6$ times is 1% by weight or less, can maintain excellent refrigeration capacity over a long term.

Now, a 2 stage GM refrigerator 10 shown in FIG. 3 shows one embodiment of a refrigerator of the present invention. The 2 stage GM refrigerator 10 shown in FIG. 3 comprises a first cylinder 11 of a large diameter and a vacuum vessel 13 provided with a second cylinder 12 of a small diameter and coaxially connected with the first cylinder 11. To the first cylinder 11, first heat regenerator 14 is disposed in a reciprocation free manner, to the second cylinder 12, the second heat regenerator 15 is disposed in a reciprocation free manner. Between the first cylinder 11 and the first heat regenerator 14, and between the second cylinder 12 and the second heat regenerator 15, sealing 16, 17 are disposed, respectively.

In the first heat regenerator 14, a first heat regenerating material 18 such as a Cu mesh and the like is accommodated. In the second heat regenerator 15, a heat regenerating material for very low temperature use of the present invention is accommodated as a second heat regenerating material 19. The first heat regenerator 14 and the second heat regenerator 15 have respectively paths of operating medium such as He and the like disposed at the space between the first heat regenerating material 18 and the heat regenerating material for very low temperature use 19.

Between the first heat regenerator 14 and the second heat regenerator 15, a first expansion room 20 is disposed. Further, between the second heat regenerator 15 and a bottom wall of the second cylinder 12, a second expansion room 21 is disposed. And, there is disposed a first cooling stage 22 at a bottom portion of the first expansion room 20, and a second cooling stage 23 of lower temperature than the first cooling stage 22 is disposed at a bottom portion of the second expansion room 21.

To the above mentioned 2 stage GM refrigerator 10, a pressurized active medium (He gas , for example) is supplied from a compressor 24. The supplied operating medium reaches the first expansion room 20 through between the first heat regenerating material 18 accommodated in the first heat regenerator 14, further reaches the second expansion room 21 through between the heat regenerating material for very low temperature use (the second heat regenerating material) 19 accommodated at the second heat regenerator 15. During this, the operating medium provides heat energy to each heat regenerating material 18, 19 to be cooled. The operating medium passed through between respective heat regenerating material 18, 19 expands in respective expansion room 20, 21 to generate coldness, thus, respective cooling stage 22, 23 is cooled. The expanded operating medium flows in a reverse direction through between respective heat regenerating material 18, 19. The operating medium is discharged after receiving heat energy from the respective heat regenerating material 18, 19. As the recuperating effect becomes good through such a process, thermal efficiency of the operating medium cycle is improved, thus further lower temperature can be realized.

Embodiment 2

COMPARATIVE EXAMPLE 2

A $HoCu_2$ mother alloy is produced with high frequency melting. This $HoCu_2$ mother alloy is melted at about 1323 K, the molten metal is dropped on a rotating disc in an Ar atmosphere (pressure=about 80 kPa) to rapidly cool and to solidify. The obtained particle aggregate is sieved, after adjustment of the particle diameter in the range of 180 to 250 $\mu$m, shape classification is carried out according to an inclined vibrating plate method to select 1 Kg of spheroidal particles body. By repeating such a process a plurality of times, 5 lots of spheroidal $HoCu_2$ particle aggregate are obtained. Here, by adjusting the condition for the shape classification, for instance, an angle of dip, a vibration strength and the like, the degree of sphericity of each lot is varied.

Next, from these 5 lots of spheroidal $HoCu_2$ particle aggregate, 300 pieces of particles are extracted at random, a circumferential length L of projection image and a true area A of the projection image of each particle are measured by image processing, thereby evaluated the shape factor R expressed by $L^2/4\pi A$. Further, for each lot, vibration test is carried out in an identical manner as the embodiment 1, the ratio of the destroyed spheroidal $HoCu_2$ particles is obtained. The shape factor R and the destruction rate of the particles due to vibration test are shown in Table 2 for each lot. As evident from Table 2, each spheroidal $HoCu_2$ particle aggregate of sample No.1 to No.4 corresponds to embodiment 2, a spheroidal $HoCu_2$ particle aggregate of sample No.5 corresponds to comparative example 2.

After the spheroidal particle aggregate of the magnetic heat regenerating material of each lot consisting of the above described $HoCu_2$ is respectively packed in the one half of the low temperature side of the heat regenerator container with a packing ratio of 63.5 to 64.0%, and, in the one half of the high temperature side, lead balls are packed, the heat regenerator container is assembled in the 2 stage GM refrigerator as a second stage heat regenerator as identical as the embodiment 1, refrigeration test was carried out as identical as embodiment 1. The results are also shown in Table 2.

TABLE 2

| | Sample No. | Ratio of particles of R > 1.5 (%) | Particle destruction rate due to vibration test (wt %) | Refrigeration capacity (W) Initial value | Refrigeration capacity (W) After 7000 hours |
|---|---|---|---|---|---|
| Embodiment 2 | 1 | 0.3 | 0.08 | 0.53 | 0.53 |
| | 2 | 1.3 | 0.26 | 0.59 | 0.56 |
| | 3 | 4.2 | 0.54 | 0.52 | 0.45 |
| | 4 | 2.5 | 0.39 | 0.57 | 0.52 |
| Comparative example 2 | 5 | 7.4 | 1.74 | 0.51 | 0.18 |

As obvious from Table 2, all of the refrigerators employing the magnetic heat regenerating particle aggregate in which the ratio of the particles destroyed when a simple harmonic oscillation of the maximum acceleration of 300 $m/s^2$ is added $1\times10^6$ times is 1% by weight or less can maintain excellent refrigeration capacity over a long term.

Embodiment 3

COMPARATIVE EXAMPLE 3

An $ErNi_{0.9}Co_{0.1}$ mother alloy is produced with high frequency melting. This $ErNi_{0.9}Co_{0.1}$ mother alloy is melted at about 1523 K, the molten metal is dropped on a rotating disc in an Ar atmosphere (pressure=about 80 kPa) to rapidly cool and to solidify. The obtained particle aggregate is appropriately shape classified and sieved, 1 Kg of the spheroidal particle aggregate of the particle diameter of 180 to 250 $\mu$m is selected. By repeating this process a plurality of times, 5 lots of spheroidal $ErNi_{0.9}Co_{0.1}$ particle aggregate are obtained.

Here, since there are differences in the raw material lots for manufacturing the mother alloy, the degree of vacuum of the atmosphere during high frequency melting, the impurity gas concentration during rapidly solidifying process, the impurity contents in the spheroidal particles are different. Nitrogen content and carbon content in the spheroidal particles are shown in Table 3. With these 5 lots of the spheroidal $ErNi_{0.9}Co_{0.1}$ particle aggregates, the vibration test were carried out in the identical manner as the embodiment 1, the ratio of the destroyed spheroidal $ErNi_{0.9}Co_{0.1}$ particles were obtained. The nitrogen content and carbon content, the particle destruction rate due to vibration test for each lot are shown in Table 3. As evident from Table 3, the spheroidal $ErNi_{0.9}Co_{0.1}$ particle aggregates of sample No.1 to sample No.4 correspond to embodiment 3, the spheroidal $ErNi_{0.9}Co_{0.1}$ particle aggregate of sample No.5 corresponds to comparative example 3.

After the spheroidal particle aggregate of the magnetic heat regenerating material of each lot consisting of the above described $ErNi_{0.9}Co_{0.1}$ is respectively packed in the one half of the low temperature side of the heat regenerator with a packing ratio of 63.4 to 64.0%, and, in the one half of the high temperature side, lead balls are packed, the heat regenerator container is assembled in the 2 stage GM refrigerator as a second stage heat regenerator as identical as the embodiment 1, refrigeration test was carried out as identical as embodiment 1. The results are also shown in Table 3.

TABLE 3

| | Sample No. | Impurity content (wt %) Nitrogen | Carbon | Particle destruction rate due to vibration test (wt %) | Refrigeration capacity (W) Initial value | After 7000 hours |
|---|---|---|---|---|---|---|
| Embodiment 3 | 1 | 0.02 | 0.01 | 0.02 | 0.68 | 0.67 |
| | 2 | 0.22 | 0.02 | 0.06 | 0.62 | 0.59 |
| | 3 | 0.06 | 0.04 | 0.33 | 0.67 | 0.61 |
| | 4 | 0.12 | 0.07 | 0.79 | 0.61 | 0.50 |
| Comparative example 3 | 5 | 0.35 | 0.15 | 1.31 | 0.67 | 0.24 |

As obvious from Table 3, all of the refrigerators employing the magnetic heat regenerating particle aggregates in which the ratio of the particles destroyed when a simple harmonic oscillation of the maximum acceleration of 300 $m/s^2$ is added $1\times10^6$ times is 1% by weight or less can maintain excellent refrigeration capacity over a long term.

Embodiment 4

COMPARATIVE EXAMPLE 4

An ErNi mother alloy, an $Er_3Co$ mother alloy, ErCu mother alloy, $Ho_2Al$ mother alloy are produced respectively with high frequency melting. These respective mother alloys are melted at about 1493 K, the molten metals were dropped on a rotating disc in an Ar atmosphere (pressure=about 80 kPa) to rapidly cool and to solidify. The obtained particle aggregates were classified adequately according to their shape and sieved to select 1 Kg of spheroidal particle aggregates of particle diameter of 180 to 250 $\mu$m. By repeating such a process a plurality of times, respective 5 lots of spheroidal particle aggregates were obtained.

With these respective spheroidal particle aggregates, the vibration test was carried out in the identical manner as the embodiment 1, the lowest lot and the highest lot (comparative example) in their destruction rate were selected, respectively. With these respective lots, measurement of the shape factor R and analysis of nitrogen and carbon content were carried out. These results are shown in Table 4.

The above described each spheroidal particle aggregate of the magnetic heat regenerating material was assembled in a refrigerator in the following manner. First, the spheroidal particle aggregate of the magnetic heat regenerating material consisting of ErNi is respectively packed in the one half of the low temperature side of the heat regenerator container with a packing ratio of 63.2 to 64.0%, and, in the one half of the high temperature side, the spheroidal particle aggregate of the magnetic heat regenerating material consisting of $Er_3Co$, ErCu, or $Ho_2Al$ are packed with the respective packing ratio of 63.0 to 64.1%, the vessel is assembled in the 2 stage GM refrigerator as a second stage heat regenerator as identical as the embodiment 1, refrigeration test was carried out as identical as embodiment 1. The results are also shown in Table 4.

TABLE 4

| Composition of magnetic heat regenerating material at higher temperature side* | Ratio of particles of R > 1.5 (%) | Impurity content (wt %) Nitrogen | Carbon | Particle destruction rate due to vibration test (wt %) | Refrigeration capacity (W) Initial value | After 7000 hours |
|---|---|---|---|---|---|---|
| Embodiment 4 | | | | | | |
| $Er_3Co$ | 4.1 | 0.01 | 0.01 | 0.07 | 0.57 | 0.50 |
| ErCu | 0.5 | 0.24 | 0.05 | 0.18 | 0.67 | 0.61 |
| $Ho_2Al$ | 1.2 | 0.02 | 0.01 | 0.29 | 0.60 | 0.60 |
| Comparative example 4 | | | | | | |
| $Er_3Co$ | 6.5 | 0.08 | 0.04 | 1.41 | 0.52 | 0.13 |
| ErCu | 0.8 | 0.32 | 0.14 | 1.52 | 0.66 | 0.26 |
| $Ho_2Al$ | 5.8 | 0.35 | 0.13 | 2.45 | 0.57 | 0.07 |

*The magnetic heat regenerating material at the low temperature side is ErNi for all cases.

Next, embodiments of an MRI device, a magnetic levitation train, a cryopump, and a magnetic field application type single crystal growth device of the present invention will be described.

Figure 4:
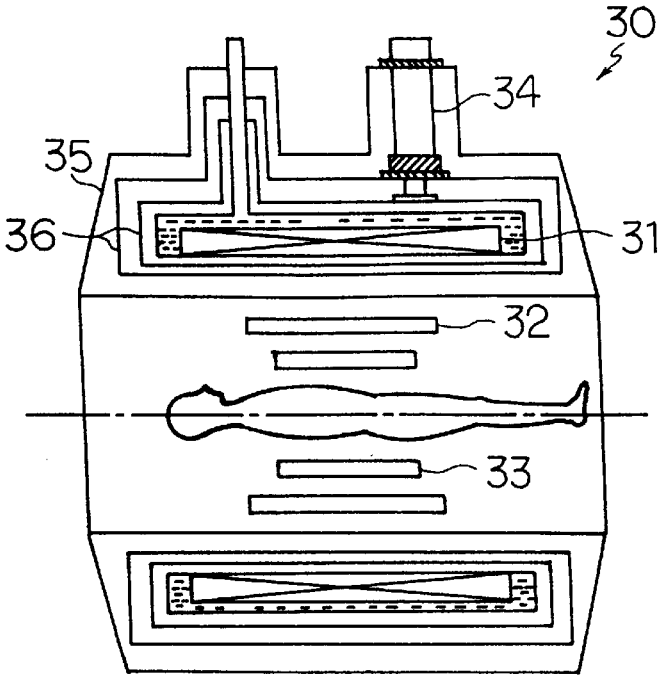
FIG. 4 is a diagram outlining the structure of a superconductive MRI device according to one embodiment of the present invention.

FIG. 4 is a diagram outlining a structure of a superconductive MRI device to which the present invention is applied. The superconductive MRI device 30 shown in the same figure is constituted of a superconductive magnetostatic field coil 31 biasing a spatially homogeneous and a temporally stable magnetostatic field to a human body, a not shown compensating coil compensating inhomogeneity of generating magnetic field, a gradient magnetic field coil 32 providing a magnetic field gradient in a measuring region, and a probe for radio wave transducer 33. And, to cool the superconductive magnetostatic field coil 31, the above described refrigerator 34 of the present invention is employed. Incidentally, in the figure, numeral 35 is a cryostat, numeral 36 is a radiation shield.

In the superconductive MRI device 30 wherein a refrigerator 34 of the present invention is applied, since an operating temperature of the superconductive magnetostatic field coil 31 can be guaranteed to be stable over a long term, a spatially homogeneous and temporally stable magnetostatic field can be obtained over a long term. Therefore, performance of a superconductive MRI device 30 can be exhibited with stability over a long term.

Figure 5:
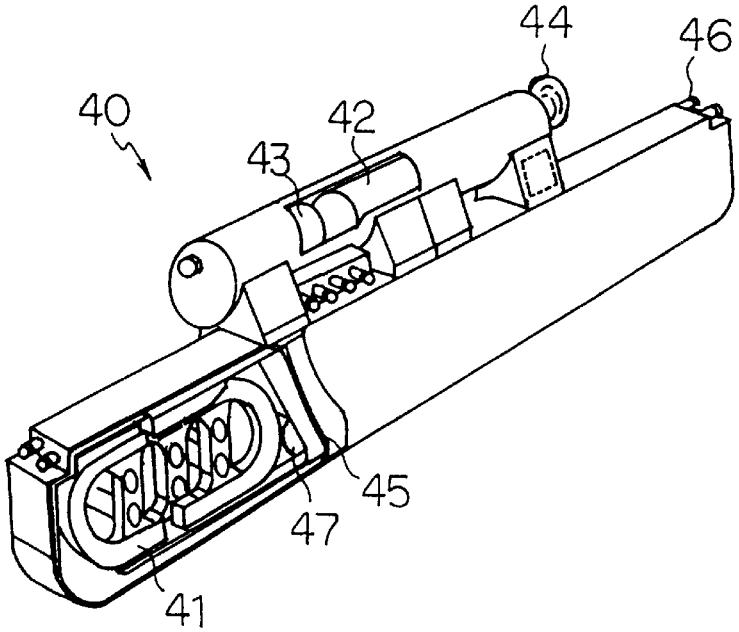
FIG. 5 is a diagram outlining an essential structure of a magnetic levitation train according to one embodiment of the present invention.

FIG. 5 is a diagram outlining a structure of an essential portion of a magnetic levitation train wherein the present invention is applied, a portion of a superconductive magnet 40 for a magnetic levitation train being showed. The superconductive magnet 40 for a magnetic levitation train shown in the same figure is constituted of a superconductive coil 41, a liquid helium tank 42 for cooling the superconductive coil 41, a liquid nitrogen tank 43 preventing evaporation of the liquid helium and a refrigerator 44 of the present invention. Incidentally, in the figure, numeral 45 is a laminated adiathermic material, numeral 46 is a power lead, numeral 47 is a persistent current switch.

In a superconductive magnet 40 for a magnetic levitation train wherein a refrigerator 44 of the present invention is employed, since the operation temperature of the superconductive coil 41 can be guaranteed to be stable over a long term, a magnetic field necessary for magnetic levitation and propulsion of a train can be obtained over a long term with stability. In particular, although acceleration operates in the superconductive magnet 40 for a magnetic levitation train, the refrigerator 44 of the present invention, being able to maintain excellent refrigeration performance over a long term even when the acceleration is operated, can remarkably contribute to the long term stability of the magnetic field and the like. Therefore, a magnetic levitation train in which such a superconductive magnet 40 is employed can exhibit its reliability over along term.

Figure 6:
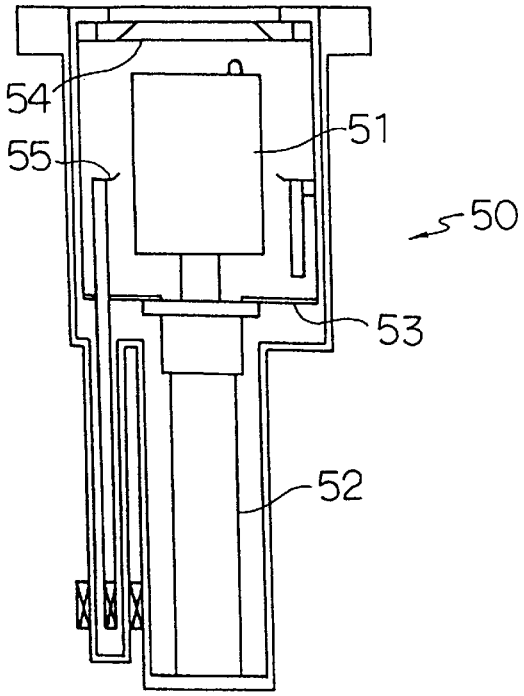
FIG. 6 is a diagram outlining a structure of a cryopump according to one embodiment of the present invention.

FIG. 6 is a diagram outlining a structure of a cryopump involved the present invention. A cryopump 50 shown in the same figure is constituted of a cryopanel 51 condensing or absorbing gas molecules, a refrigerator 52 of the present invention cooling the cryopanel 51 to a predetermined very low temperature, a shield 53 disposed therebetween, a baffle 54 disposed at an air intake, and a ring 55 varying exhaust speed of Ar, nitrogen, hydrogen.

With a cryopump 50 involving a refrigerator 52 of the present invention, the operating temperature of the cryopanel 51 can be guaranteed to be stable over a long term. Therefore, the performance of the cryopump 50 can be exhibited over a long term with stability.

Figure 7:
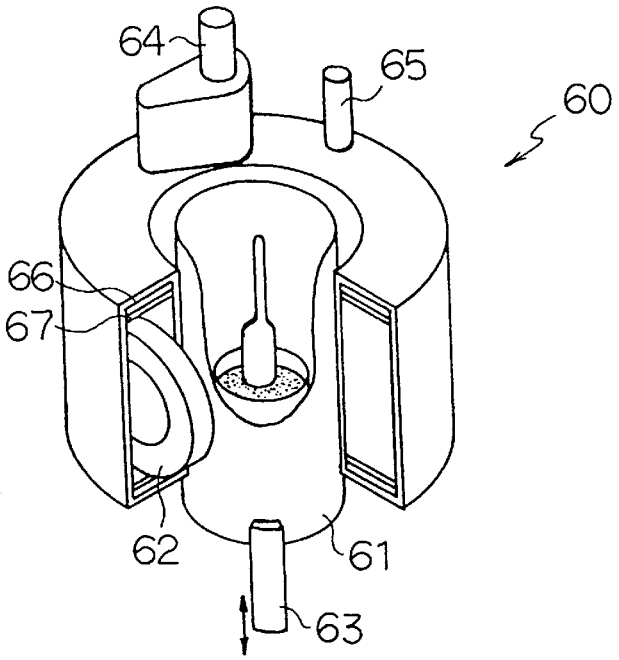
FIG. 7 is a diagram outlining an essential structure of a magnetic field application type single crystal growth device according to one embodiment of the present invention.

FIG. 7 is a diagram outlining a structure of a magnetic field application type single crystal growth device involving the present invention. A magnetic field application type single crystal growth device 60 shown in the same figure is constituted of a crucible for melting raw material, a heater, a single crystal growth portion 61 possessing a mechanism pulling up a single crystal, a superconductive coil 62 applying a magnetostatic field to a raw material melt, and an elevation mechanism 63 of the single crystal pulling up portion 61. And, as a cooling means of the superconductive coil 62, the above described refrigerator 64 of the present invention is employed. Now, in the figure, numeral 65 is a current lead, numeral 66 is a heat shield plate, numeral 67 is a helium container.

With a magnetic field application type single crystal growth device 60 involving a refrigerator 64 of the present invention, since the operating temperature of the superconductive coil 62 can be guaranteed to be stable over a long term, a good magnetic field suppressing convection of the raw material melt of the single crystal can be obtained over a long term. Therefore, the performance of the magnetic field application type single crystal growth device 60 can be exhibited with stability over a long term.

Industrial Applicability

As evident from the above described embodiments, according to a heat regenerating material for very low temperature use of the present invention, mechanical characteristics excellent against mechanical vibration and acceleration can be obtained with reproducibility. Therefore, a refrigerator of the present invention employing such a heat regenerating material for very low temperature use can maintain excellent refrigeration performance with reproducibility over a long term. In addition, an MRI device, a cryopump, a magnetic levitation train, and a magnetic field application type single crystal growth device of the present invention employing such a refrigerator can exhibit an excellent performance over a long term.

What is claimed is:

1. A heat regenerating material for very low temperature use, comprising:

a magnetic heat regenerating material particle aggregate, wherein, among magnetic heat regenerating material particles constituting the magnetic heat regenerating material particle aggregate, a ratio of the magnetic heat regenerating material particles being destroyed when a simple harmonic oscillation of the maximum acceleration of 300 $m/s^2$ is applied $1\times10^6$ times on the magnetic heat regenerating material particle aggregate is 1% by weight or less.

2. The heat regenerating material as set forth in claim 1:

wherein, the magnetic heat regenerating material particle is a magnetic heat regenerating material of which nitrogen content is 0.3% by weight or less.

3. The heat regenerating material as set forth in claim 1:

wherein, the magnetic heat regenerating material particle is a magnetic heat regenerating material of which carbon content is 0.1% by weight or less.

4. The heat regenerating material for very low temperature use as set forth in claim 1:

wherein, when a circumferential length of a projection image of the individual magnetic heat regenerating material particle is designated as L, a true area of the projection image is designated as A, in the magnetic heat regenerating material particle aggregate, a ratio of the magnetic heat regenerating material particles of which shape factor R, expressed by $L^2/4\pi A$, exceeds 1.5 is 5% or less.

5. The heat regenerating material for very low temperature use as set forth in claim 1:

wherein, the magnetic heat regenerating material particle aggregate is a heat regenerating material for very low temperature use in which 70% by weight or more of the magnetic heat regenerating material particles possesses particle diameters in the range of 0.01 to 3.0 mm.

6. The heat regenerating material for very low temperature use as set forth in claim 1:

wherein, the magnetic heat regenerating material particle aggregate consists essentially of an intermetallic compound including a rare earth element and expressed by the following formula, general formula: RMz (in the formula, R denotes at least one kind of rare earth element selected from Y, La, Ce, Pr, Nd, Pm, Sm, Eu, Gd, Tb, Dy, Ho, Er, Tm and Yb, M denotes at least one kind of metallic element selected from Ni, Co, Cu, Ag, Al and Ru, z denotes a number of in the range of 0.001 to 9.0) or general formula: RRh (in the formula, R denotes at least one kind of rare earth element selected from Y, La, Ce, Pr, Nd, Pm, Sm, Eu, Gd, Tb, Dy, Ho, Er, Tm and Yb).

7. A refrigerator, comprising:

a heat regenerator container, and a heat regenerator having a heat regenerating material for very low temperature use consisting of a magnetic heat regenerating material particle aggregate packed in the heat regenerator container, wherein, among magnetic heat regenerating material particles constituting the magnetic heat regenerating material particle aggregate, a ratio of the magnetic heat regenerating material particles being destroyed when a simple harmonic oscillation of the maximum acceleration of 300 $m/s^2$ is applied $1\times10^6$ times on the magnetic heat regenerating material particle aggregate is 1% by weight or less.

8. The refrigerator as set forth in claim 7:

wherein, the magnetic heat regenerating material particle is 0.3% by weight or less in its nitrogen content.

9. The refrigerator as set forth in claim 7:

wherein, the magnetic heat regenerating material particle is 0.1% by weight or less in its carbon content.

10. The refrigerator as set forth in claim 7:

wherein, when a circumferential length of a projection image of the individual magnetic heat regenerating material particle is designated as L, a true area of the projection image is designated as A, in the magnetic heat regenerating material particle aggregate, a ratio of the magnetic heat regenerating material particles of which shape factor R, expressed by $L^2/4\pi A$, exceeds 1.5 is 5% or less.

11. The refrigerator as set forth in claim 7:

wherein, in the magnetic heat regenerating material particle aggregate, 70% by weight or more of the magnetic heat regenerating material particles possess particle diameters in the range of 0.01 to 3.0 mm.

12. The refrigerator as set forth in claim 7:

wherein, the magnetic heat regenerating material particle aggregate consists essentially of an intermetallic compound including a rate earth element and expressed by the following formula, general formula: RMz (in the formula, R denotes at least one kind of rare earth element selected from Y, La, Ce, Pr, Nd, Pm, Sm, Eu, Gd, Tb, Dy, Ho, Er, Tm and Yb, M denotes at least one kind of metallic element selected from Ni, Co, Cu, Ag, Al and Ru, z denotes a number of in the range of 0.001 to 9.0) or general formula: RRh (in the formula, R denotes at least one kind of rare earth element selected from Y, La, Ce, Pr, Nd, Pm, Sm, Eu, Gd, Tb, Dy, Ho, Er, Tm and Yb).

13. An MRI device, comprising:

a refrigerator as set forth in claim 7.

14. A cryopump, comprising:

a refrigerator as set forth in claim 7.

15. A magnetic levitation train, comprising:

a refrigerator as set forth in claim 7.

16. A single crystal growth apparatus having a magnetic field application, comprising:

a refrigerator as set forth in claim 7.

17. A manufacturing method of a heat regenerating material for very low temperature use comprising the steps of:

providing magnetic heat regenerating material particles, testing the particles by applying a simple harmonic oscillation of the maximum acceleration of 300 $m/s^2$ and $1\times10^6$ times to a representative sample of the magnetic heat regenerating material particles, and selecting the magnetic heat regenerating material particles in which the representative sample of magnetic heat regenerating material particles comprise 1% by weight or less or destroyed particles.

18. A manufacturing method of a heat regenerating material for very low temperature use comprising the steps of:

providing magnetic heat regenerating material particles, testing the particles by applying a simple harmonic oscillation of the maximum acceleration of 300 $m/s^2$ and $1\times10^6$ times to a sample of particles extracted from the magnetic heat regenerating material particles, and selecting the magnetic heat regenerating material particles in which the extracted sample of magnetic heat regenerating material particles comprise 1% by weight or less of destroyed particles.

19. A manufacturing method of a heat regenerating material for very low temperature use comprising the steps of:

providing a plurality of batches of magnetic heat regenerating material particles, testing each batch of magnetic heat regenerating material particles by applying a simple harmonic oscillation of the maximum acceleration of 300 $m/s^2$ and $1\times10^6$ times to a representative sample of particles extracted from each batch, and selecting the batches in which the representative sample of particles comprise 1% by weight or less of destroyed particles.

* * * * *

UNITED STATES PATENT AND TRADEMARK OFFICE

CERTIFICATE OF CORRECTION

PATENT NO. : 6,197,127 B1
DATED : March 6, 2001
INVENTOR(S) : Okamura et al.

It is certified that error appears in the above-identified patent and that said Letters Patent is hereby corrected as shown below:

Column 1,
Line 56, after "Therefore," delete "a";

Column 5,
Line 66, after "smooth" delete "." and insert therefor -- , --;

Column 7,
Line 4, delete "anessential" and insert therefore -- an essential --;

Column 8,
Line 2, after "also" delete "." and insert therefore -- , --;
Line 2, delete "The result" and insert therefore -- The results --;
Line 57, after "expansion room 20" delete ".";

Column 12,
Line 16, after "embodiment 1" delete "." and insert therefore -- , --.

Signed and Sealed this

Twelfth Day of March, 2002

*Attest:*

*Attesting Officer*

JAMES E. ROGAN
*Director of the United States Patent and Trademark Office*